United States Patent [19]

Allen et al.

[11] 4,335,927

[45] Jun. 22, 1982

[54] MULTI-CIRCUIT ROTARY ELECTRICAL CONDUCTOR ASSEMBLY

[75] Inventors: Terry S. Allen; Peter E. Jacobson, both of Phoenix, Ariz.

[73] Assignee: Sperry Corporation, New York, N.Y.

[21] Appl. No.: 132,243

[22] Filed: Mar. 20, 1980

[51] Int. Cl.[3] ..... H01R 39/00

[52] U.S. Cl. ..... 339/5 R; 74/5.6 D

[58] Field of Search ..... 339/5, 6, 8; 74/5.34, 74/5.6 D

[56] References Cited

U.S. PATENT DOCUMENTS 4,068,909 1/1978 Jacobson et al. ..... 339/5 R 4,098,546 7/1978 Swartz et al. ..... 339/5 R

*Primary Examiner*—Joseph H. McGlynn

*Assistant Examiner*—Frank H. McKenzie, Jr.

*Attorney, Agent, or Firm*—Howard P. Terry; Richard J. McGrath

[57] ABSTRACT

A full or partial rotational, substantially zero friction electrical conductor assembly conducts the electrical currents of a large number of electrical circuits between a pair of relatively rotatable members in a minimum axial length. A plurality of concentric, annular, radially spaced gaps are formed between corresponding concentric, concave surfaced, electrically conductive rings affixed to the members, such that a large number of circuits may be accommodated in a reduced axial length assembly. Resilient, filamentary conductor loops are disposed between the conductive rings, and the loops contact, roll on, and are captured by the concave surfaces of the conductive rings, thereby providing electrical continuity between the relatively rotatable members. The conductor loops are sealed within individual structural enclosures, thus, providing an environmentally clean and rugged assembly.

6 Claims, 5 Drawing Figures

MULTI-CIRCUIT ROTARY ELECTRICAL CONDUCTOR ASSEMBLY

BACKGROUND OF THE INVENTION

1. Field of the Invention

The present invention relates generally to improvements in the electrical current transfer device for transferring electrical current between relatively rotatable members, the broad class of such devices generally being referred to as slip rings. Specifically, the invention relates to an improved current transfer device for conducting currents between stator and rotor members, such as between the relatively rotatable members utilized in aerospace applications which require the reliable and long life expectancy transfer of electrical currents from a large number of circuits across a relatively short distance measured along the axial length of the relatively rotatable members.

2. Description of the Prior Art

Rolling electrical conductor assemblies are not broadly new and have heretofore been proposed for use in place of the more conventional slip ring and brush assemblies. For example, U.S. Pat. No. 4,098,546 issued to the Applicants' assignee, discloses a full rotational freedom, substantially zero friction electrical conductor assembly for conducting electrical currents between relatively rotatable members of sensitive instruments such as gyroscopic devices and the like. Each electrical transfer unit of the assembly comprises a pair of coaxial, concentric, coplanar continuous, concave conductor rings, one mounted on a relatively fixed member and the other mounted on a rotatable member, the relative diameters of the rings providing a substantial annular radial gap therebetween. A resilient electrically conducting continuous, filamentary loop is disposed in the radial gap such that its generally flat outside surface contacts and rolls on the concave surface of the conductor rings. The loop or conductor interface provices self-capturing and retaining forces to accommodate any misalignment between the rings and movements of the loops within the radial gap in a vibratory and/or shock environment, all without producing frictional torques on the rotatable member.

The major disadvantage of the above described invention is that only a limited number of electrical currents can be transferred across a relatively short distance measured along the axial length of the relatively rotatable members. When the axial length is increased to accommodate a larger number of circuits that require electrical currents to be transferred between the relatively rotatable members, the increased length induces thermal and vibratory problems which result in a bulky, difficult to assemble, and possibly unstable structure unsuited for many environments. All known prior art attempts to solve the problem of the transfer of electrical current from high density electrical circuits between relatively rotatable members have been unsuccessful or have concentrated on increasing the axial length of the relatively rotatable members. In addition to the volumetric problems associated with the transfer of electrical current from high density electrical circuits between relatively rotatable members, there is also a need for an extremely dependable and an environmentally sound device which can operate efficiently under the adverse conditions which are common in aerospace and satellite applications. Facilitation of repairs as well as reliability are characteristics which are needed. Therefore, there is a need to provide the aerospace industry with a solution to the problem of the transfer of electrical currents from high density electrical circuits across relatively rotatable members such that efficient and reliable operation of satellite structures and/or sensitive instruments, such as gyroscopic devices may be provided under sometimes harsh environmental conditions characteristic of aerospace applications. The practice of the present invention can provide the aerospace industry with an environmentally rugged electrical conductor assembly which can efficiently transfer electrical currents from as many as 200 circuits across a distance of 13 inches measured along the axial length of the relatively rotatable members.

SUMMARY OF THE INVENTION

In accordance with the invention, the aforementioned difficulties with respect to the transfer of electrical currents in high density electrical circuits between relatively rotatable members are to a great extent alleviated through the practice of this invention. The present invention provides an electrical conductor assembly having a plurality of annular, radially spaced gaps formed between concentric conductive rings affixed to the stator and the rotor members within annular, radially spaced openings formed in the members. Resilient, filamentary conductive loops with a free diameter greater than the width of the annular radial gaps are disposed within the gaps and contact and roll on juxtaposed surfaces of the electrical conductive rings. Unlike the prior art electrical conductor assemblies which have only one radial annular gap for the conductor loops, the present invention has a plurality of annular concentric radial gaps, and thus the increased number of annular radial gaps can accommodate a larger number of electrical circuits. More specifically, the annular radial gaps are defined by perpendicular walls that extend from the surfaces of the relatively rotatable members. These perpendicular walls may form sealed enclosures within which the electrical conductor loops may roll and contact the surfaces of the electrically conductive rings. The electrically conductive rings are coupled to electrical conductors, thereby establishing electrical continuity across the stator and rotor members for a larger number of electric circuits without inducing vibratory and thermal problems that are associated with an increased axial length otherwise required to accommodate large numbers of circuits.

DESCRIPTION OF THE PREFERRED EMBODIMENT

Figure 1:
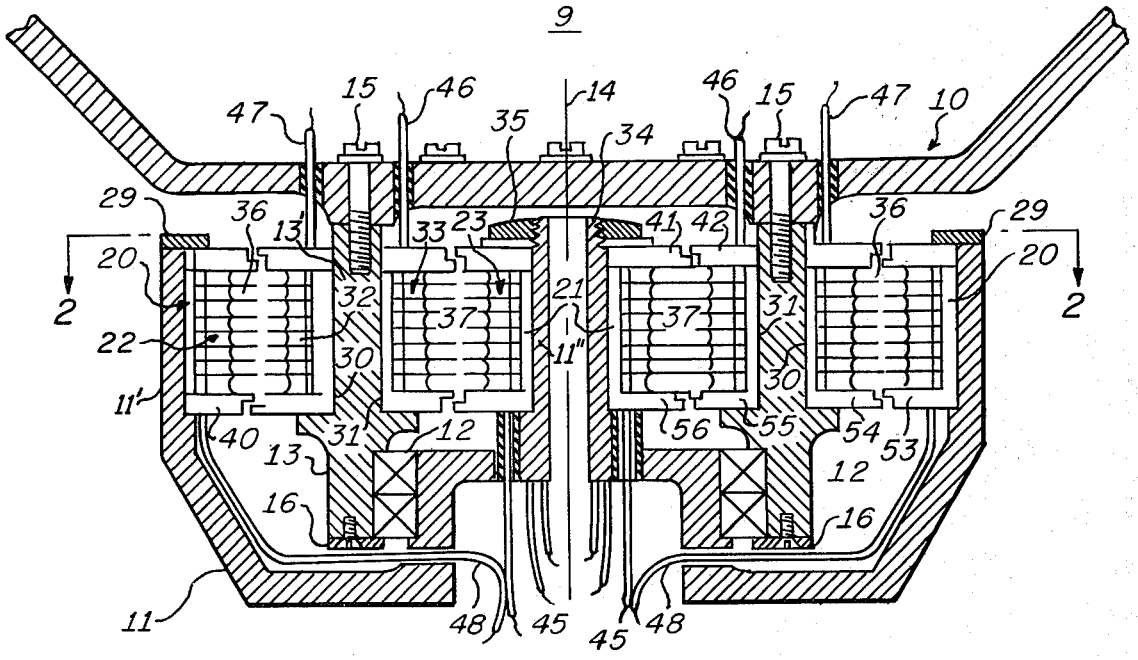
FIG. 1 is a sectional view of the electrical conductor assembly of the present invention incorporated for illustrative purposes at one of the gimbal axes of a gyroscopic device.

Referring to FIG. 1, an enlarged partial section of a gyroscopic gimbal support bearing device is illustrated, specifically, and by way of example, a section of the electrical current transfer apparatus associated with the support between the gimbal 10, i.e., the rotary member, and a base or housing 11, i.e., the stationary member. As shown, the stationary housing 11 supports the gimbal 10 in precision ball bearings 12 through a trunnion 13 mounted on the gimbal 10 for rotation about the common axis 14 and includes passageways for conductors 45 from stationary electrical apparatus to the conductor assembly of the invention. The trunnion 13 is cylindrical and provides passages for electrical leads 46 from the electrical conductor assembly of the invention to the electrical apparatus carried on the gimbal assembly. The trunnion 13 is secured to the gimbal 10 by suitable means such as mounting bolts 15. A bearing retainer ring and clamping screws 16 serve to clamp the ball bearings 12 in place. Thus, the relatively rotatable members include a plurality of annular, radially spaced, overlapping walls 11', 11'' and 13' extending parallel with common axis 14 which define a plurality of radially spaced, concentric openings 36, 37 therebetween. It will be understood of course that the invention is also applicable in structures other than gyroscopes or the like; for example, it is highly applicable in transferring electrical current between the relatively rotatable structures of space vehicles such as between spun and despun structures of satellites and pointing system axes of satellites.

The electrical conductor assembly of the present invention serves to transfer a plurality of electrical power and/or signals between the stationary housing 11 and the relatively rotatable gimbal 10 with substantially zero mechanical friction and coupling torques. Generally, the conductor assembly comprises a fixed outer cylindrical housing 11, and an integral inner reentrant cylindrical support 11' defining axially coextensive interior cylindrical surface 21 and exterior cylindrical surface 20 respectively. Evenly and axially distributed along the surface 20 and 21 of the housing 11 are sets of coplanar, circular, concave-faced electrically conductive rings 22 and 23. Hereinafter the conductive rings 22 will be referred to as the outer housing conductor rings and the conductive rings 23 will be referred to as the inner housing conductor rings. The housing rings 22, 23 as shown in more detail in FIG. 3, may be made from a suitable electrically conductive material and a gold alloy conventionally used for such applications is deposited on the concave surfaces of the housing rings as taught in the above referenced patent. The cylindrical trunnion member 13 has an outer surface 30 and an inner surface 31 each axially coextensive with corresponding surfaces 20 and 21. Evenly distributed along the inner surface 31 and the outer surface 30 of the trunnion 13 are similar sets of circular, concave-faced, electrically conductive rings 32 and 33. Hereinafter the conductive rings 32 will be referred to as the outer trunnion conductor rings and the conductive rings 33 will be referred to as the inner trunnion conductor rings. The trunnion conductor rings 32, 33 may be fabricated like rings 22 and 23. The rings 22, 23, 32 and 33 are separated from each other by suitable insulation wafers or spacers 40 made from plastic or some other suitable insulating material. Each inner housing conductor ring 23 is so located within the housing 11 that it is accurately and axially aligned so as to be coplanar with a corresponding inner trunnion conductive ring 33 associated with the trunnion 13. The radial dimensions of rings 23, 33 define a substantial annular radial gap 37. Similarly, each outer housing conductor ring 22 is so located within the housing 11 that it is accurately and axially aligned with a corresponding outer trunnion conductive ring 32 associated with the trunnion 13. The radial dimensions of rings 22, 32 define a substantial annular radial gap 36. Within each of these concentric, radially spaced gaps 36, 37 is located at least one resilient filamentary conductor loop which contacts and rolls on the concave contact surfaces of the conductor rings 22, 32 and 23, 33. The contact interfaces between the conductor rings and the filamentary conductor loops are the same, or substantially the same as taught in the referenced patent whereby the loops are self captured and self aligned between the rings. The separator walls 40 form individual enclosures that effectively seal each conductor loop from one another so that, in the unlikely event that any loop fractures, it will be isolated and will not destroy or short circuit another conductor. The walls 40 further protect the conductor loop from damage during module assembly. The spacers 40 have radii such that they extend into the annular radial gaps 36 and 37, and a small annular clearance is left between spacers to form sealed enclosures for each of said loops. Similarly, end caps 41, 42 extend radially across the gaps 36, 37 at each end and may be so configured to form a labyrinth seal for protecting the gap cavities 36 and 37 from contaminants.

In practice, the electrical conductor generally described above is built up from separate components and secured together with suitable fasteners, such as bolts, to form annular module assemblies as hereinafter described. The modules are then inserted and fastened into the housing and trunnion annular spaces to produce the overall conductor assembly. For example, the concentric modules are held in place by a threaded portion 34 of the housing reentrant cylinder portion and nut 35 and by the suitable ring retainers 29 attached to the cylindrical trunnion 13 and housing 11. Of course, the electrical conductor assembly may be constructed using the molded plastic techniques disclosed in the above U.S. Pat. No. 4,098,546.

It should also be noted that holes are drilled through the gimbal or rotor element 10 to provide passage for the electrical conductors 46, 47 which extend to electrical components carried by the gimbal, and similar holes are drilled into the housing 11 for passage of electrical conductors 45, 48 which extend to fixed electrical components associated with the housing. It can be seen from the embodiment of FIG. 1, that there is a total of 16 separate circuits which can be accommodated by the electrical conductor assembly depicted therein. However, if extremely high reliability is desired, the conductor leads may be cross-strapped to provide two conductor/loop contacts per circuit. For example, electrical leads 47, 48, FIG. 2, which are coupled to one set of conductor rings 32, 22 may be connected to electrical leads 46, 45 respectively, which are coupled to a corresponding set of conductive rings 33, 23 to provide parallel or redundant conductor/loop circuits between the rotor and stator members. This redundant circuit arrangement may be very advantageous in space applications, such that if one of the filamentary conductor loops should fail, the other conductor loop will maintain electrical continuity. Alternatively, the conductor rings 32, 33 may be formed as an integral ring rather than separate rings for this purpose.

Figure 2:
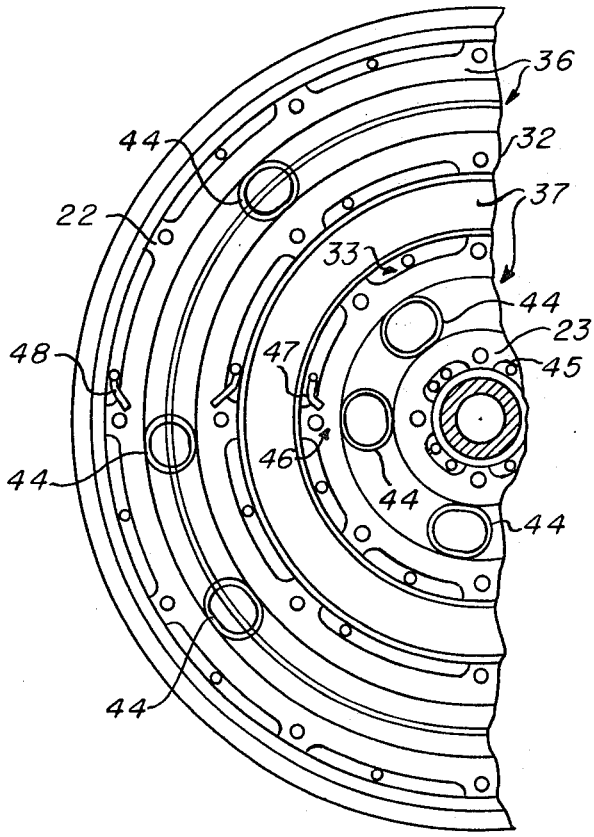
FIG. 2 is a partial sectional view of the assembly taken on line 2—2 of FIG. 1.

Referring now to FIG. 2, an end view of the folded contact assembly of the present invention illustrates a typical random disposition of circular filamentary conductor loops 44 within the annular radial gaps 36 and 37. As taught in the referenced patent, electrically conducting, continuous filamentary loops 44, disposed in the annular radial gap 36, at least one loop per ring set, have a generally rectangular cross section such that their outer edge surfaces, which may preferably include a rounded chamfer to enhance electrical conductivity, contact and roll on the facing concave surfaces of the concentric rings 22 and 32 thereby providing loop-retaining mechanical forces and electrical continuity between the leads 48, 47. Likewise, a plurality of resilient, electrically conductive, continuous filamentary loops 44 are disposed in the annular radial gap 37, that is, one loop 44 per ring set 23, 33, such that their outer generally flat surfaces contact and roll on the concave surfaces of the concentric rings 23, 33.

The primary consideration governing the selection of design parameters for the resilient, filamentary, conductor loops are minimizing the effective contact resistance, over a given operational life, at the loop conductor interface, maximizing the self-retention capability of the loops between the rings in a shock and vibratory environment without contributing significant coupling torques, maximizing the current conduction capability of the loop/conductor ring interface, and maximizing the reliability and life of the assembly. It should be noted from FIG. 2, that the conductor loops 44 and the conductive rings 22, 23, 32 and 33 are all interior of the assembly housing 11, and they are therefore, protected from neighboring apparatus in use and are not exposed to accidental contact or snagging during normal handling.

Figure 3:
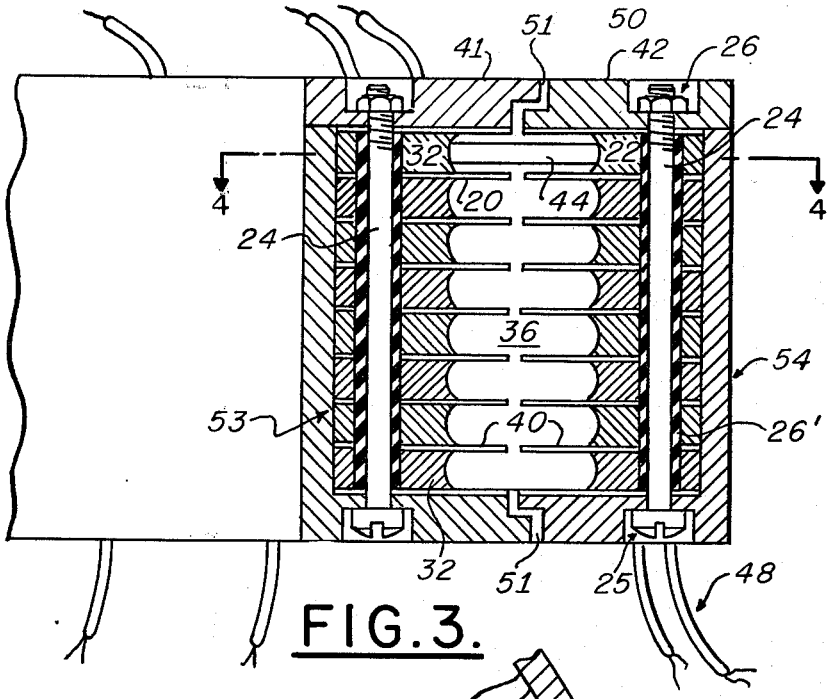
FIG. 3 is an enlarged partial sectional view of one of the electrical conductor assembly modules of FIG. 1.

Referring now to FIG. 3, there is shown an enlarged partial sectional view of the electrical conductor assembly of this invention and it illustrates in more detail a preferred configuration of the conductors/loop annular modules. Contained within the module 50 there is a typical loop 44/outer housing conductive ring 22 interface, as well as a typical loop 44/outer trunnion conductive ring 32 interface. The facing concave surfaces of the conductive rings 22, 32 provide self-capturing and retention forces for the loop 44 compressed therebetween, and the depth of the concavity is selected depending upon the severity of the shock and vibratory environment in which the gyroscope is to be operated, as taught in the referenced patent. Furthermore, the insulator spacers 40 disposed between adjacent rings of the ring set 22, 32 extend across the radial annular gap 36 so as to leave a very small gap, preferably on the order of a few thousandths of an inch. The insulated spacers 40 form individual annular enclosures or chambers for each of the conductor loops 44, such that wear debris is prevented from fouling the other loops as described above. It can also be seen, that the end caps 41, 42 also extend across the annular radial gap 36 and are configured to provide labyrinth like seals 51. The outer labyrinth seals 51 define small gaps, preferably on the order of 0.010 inch, between the end caps 41, 42 which prevent foreign objects from contaminating the interior of the assembly in use and also serve the additional function of maintaining the assembled components of the modules together for assembly into the housing and for protecting the conductor loop 44 from damage prior to and during such assembly. Particularly in space applications, it may be desirable to drill large holes in the end caps 41, 42 to facilitate evacuation during depressurization and while in orbit where contamination is not generally a severe problem.

It should be understood that in some applications the arcuate surfaces of the conductive rings 22, 23 may need to be formed on only one of the conductive rings depending upon the severity of the environment. Preferably, the conductive rings 22, 23 are fabricated from copper alloy and machined to the desired concave shape, and then alloys of rhodium, nickel and gold, or other suitable material combinations are successively plated or deposited thereon to form the finished concave conductive rings. Alternatively, as taught in U.S. Pat. No. 4,098,546, concave grooves may be machined or otherwise formed on the surfaces of the plastic housing 11 and the trunnion 13 to the desired radius and depth, after which they are suitably masked and a gold alloy is deposited on the groove or concave surface to the desired thickness. The conductor loops 44 are also plated to enhance the electrical conductivity characteristics of the conductor assembly.

As shown in FIG. 3, the annular module assembly is built up by successively stacking the rings 32, 22 and insulation wafers 40 on insulation covered bolts 24 within the module walls 53, 54. The resulting module is installed in the annular spaces between the housing 11 and the gimbal 10 where it is secured in place, as described above. For example, holes are drilled in the lower flanges of the module wall 53, 54 to receive upstanding assembly bolts 26. The bolts are provided with an insulating sleeve 26'. A first set of insulated spacers 40 and conductive rings 22 and 32 are then placed on the insulated bolts 24 and the filamentary conductor loop 44 is then compressed between the rings 22, 32. The second layer of insulated spacers 40 and conductive rings 22, 32 are placed over the first layer and conductor loop 44 compressed between the rings. This procedure is repeated until the module is filled. The end caps, 41, 42 are then placed over the top wafer 40. The fastening nuts 25 are then threaded onto the assembly bolts 26 to hold the module 50 together. Note that the labyrinth seal serves to maintain the integrity of the module during its assembly into the housing.

Figure 4:
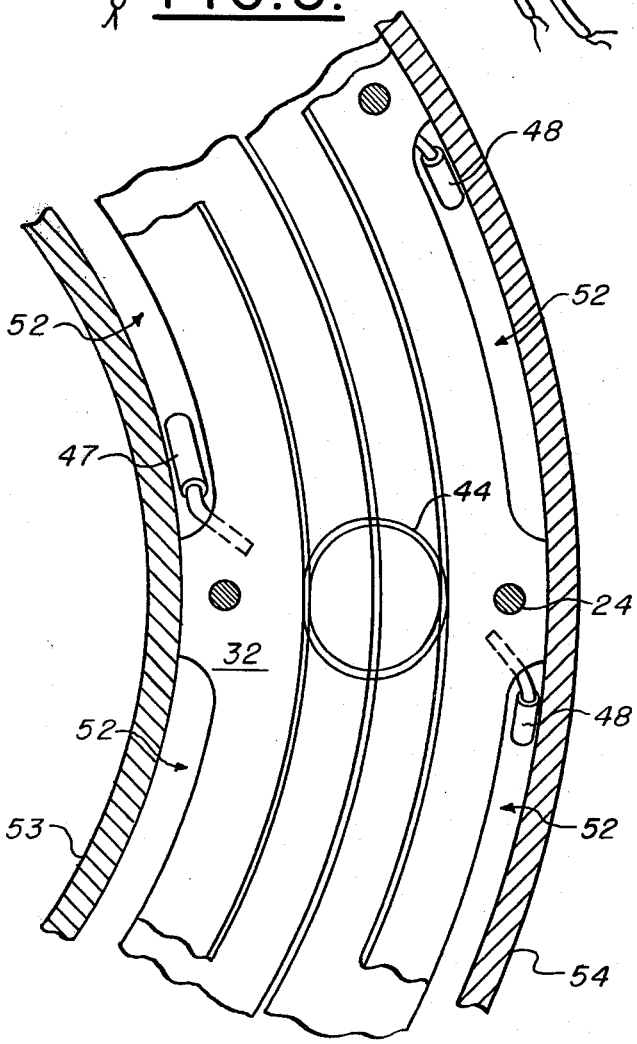
FIG. 4 is an enlarged partial sectional view of the module of FIG. 3 taken along line 4—4 thereof.

Referring now to FIG. 4, an enlarged partial end view of the electrical conductor assembly illustrating further features is provided. The periphery of the rings are cut away to provide longitudinal channels 52 extending from the end caps 41, 42 and along the interior surfaces of the module walls 53, 54, thereby providing passageways for the leads 47 and 48. The portions of the outer trunnion conductive rings 32 which abut the module wall 53 and the portions of the outer housing conductive rings 22 which abut the module wall 54 as well as the abutting spacers 40 are cut out so that the channels 52 extend from the bottom of the module walls to the end caps 41, 42. The conductors 47 and 48 are insulated wires which are soldered to holes drilled into the conductive rings 32 and 22, respectively. Preferably, the leads are soldered to the rings prior to their assembly to form the module.

Figure 5:
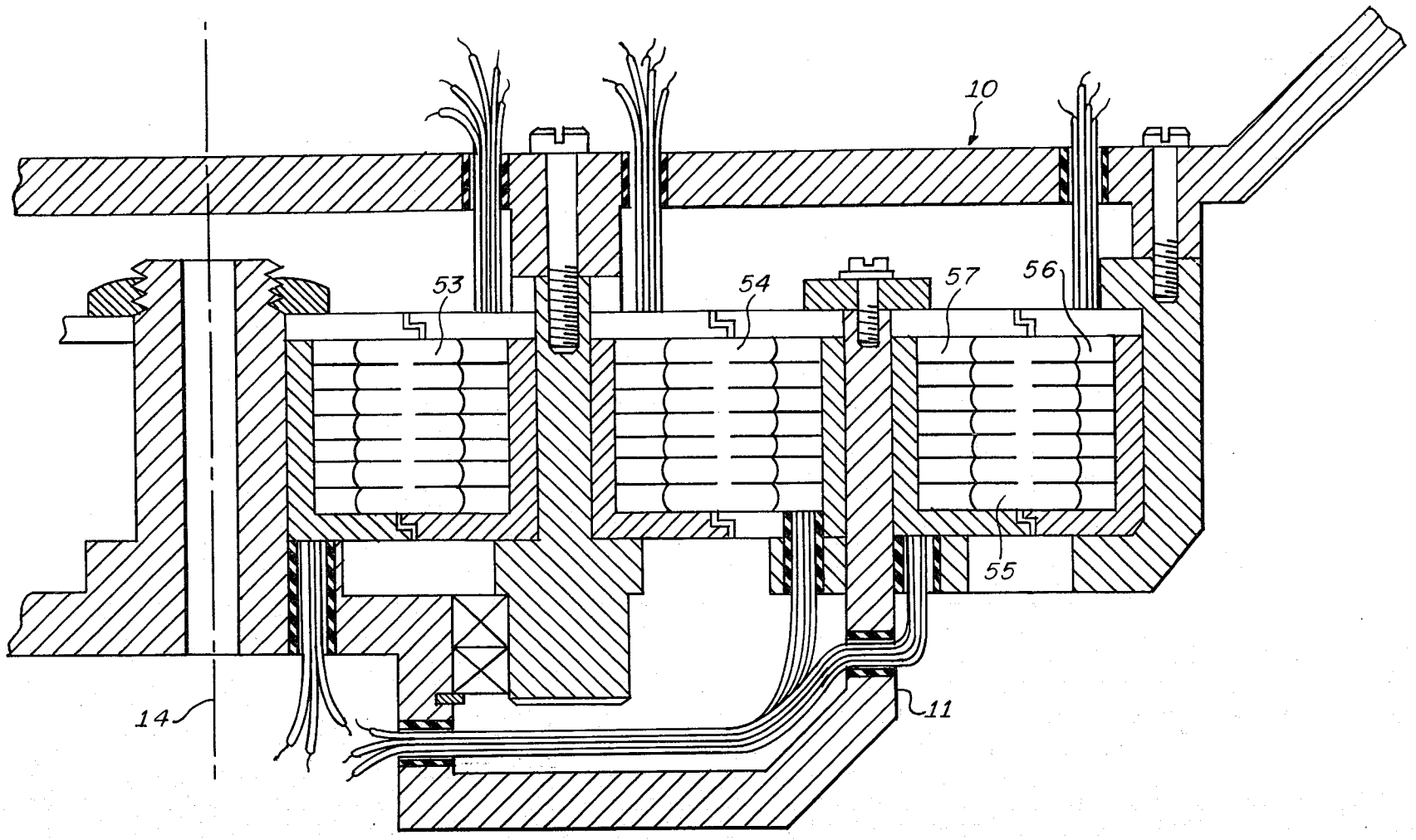
FIG. 5 is a partial sectional view of a further embodiment of the present invention having three annular radial gaps instead of the two annular radial gaps as depicted in FIGS. 1 and 2.

Referring now to FIG. 5, a partial sectional view of an electrical conductor assembly constituting a further preferred embodiment of the present invention is provided. This embodiment provides an even greater number of circuits in the same axial direction. Three angular radial gaps 53, 54 and 55 are provided instead of the two annular radial gaps as depicted in the embodiment of FIGS. 1–4. Construction of the electrical conductor assembly having three annular radial gaps 53, 54, 55 is substantially the same as the construction of the FIGS. 1–4 embodiment. Note that an additional trunnion cylinder, an additional set of trunnion conductive rings 56 as well as housing conductor rings 57, and the components associated therewith are needed. Obviously, the radial expansion of conductor assemblies may be continued to any practical limit desired.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. A conductor assembly for conducting the electrical energy of a plurality of electrical circuits across the axis of rotation of a rotary joint comprising:

a first member rotatable about said axis of rotation having a first cylindrical surface and having a second cylindrical surface of greater diameter than said first cylindrical surface, a second member rotatable about said axis of rotation, having a third cylindrical surface and a fourth cylindrical surface which are disposed between the first and second cylindrical surfaces of said first member, at least a first pair of circular, coplanar, electrically conductive rings, one thereof being disposed on the first cylindrical surface of said first member and the other thereof being disposed on the third cylindrical surface of said second member, the respective diameters of said first pair of rings providing a first relatively large radial gap therebetween, at least a second pair of circular, coplanar, electrically conductive rings, one thereof being disposed on the second cylindrical surface of said first member and the other thereof being disposed on the fourth cylindrical surface of said second member, the respective diameters of said second pair of rings providing a second relatively large radial gap therebetween.

at least one resilient, filamentary, conductive circular loop disposed in each of said first and second gaps having a free diameter greater than the radius of said gap whereby said loops produce compressive forces on said rings for providing electrical conductivity between said pairs of rings, the relative diameters of said first and second pairs of rings being such that they lie in a substantially common plane normal to said axis, whereby said plurality of circuits are accommodated without substantially increasing the length of said conductor assembly along said axis.

2. The conductor assembly as set forth in claim 1 wherein one ring of each of said pairs of rings are electrically connected with a common electrical circuit associated with one of said members and the other ring of each of said pairs of rings are electrically connected with a common electrical circuit associated with the other of said members whereby said conductive circular loops provide redundant electrical coupling between said relatively rotatable members.

3. The conductor assembly as set forth in claim 1 wherein at least one of the facing surfaces of each of said pairs of rings have a relatively shallow, arcuately concave configuration and wherein each of said circular conductive loops have a substantially flat exterior surface, the spaced outer edges thereof contacting said concave surfaces along varying lines of contact dependent upon any limited axial, radial, and angular misalignments between said rings upon relative movements between said members, and wherein said compressive forces between said loops and concave surfaces produce force components on said loops in directions such as to maintain said loops within said concave surfaces.

4. The conductor assembly as set forth in claims 1 or 3 wherein said first and second and third and fourth pairs of conductive rings and their associated conductive circular loops assemblies are each but one of a plurality of substantially identical pairs of rings and associated circular loops assemblies, said plurality of assemblies extending seriatim parallel with said common axis, each assembly further including annular insulator means for electrically insulating adjacent rings from each other.

5. The conductor assembly as set forth in claim 4 wherein each of said annular insulator rings extends substantially into said annular gaps to thereby define individual chambers for each of said circular conductor loops.

6. A conductor assembly according to claim 1 wherein, said first member further includes a fifth cylindrical surface of greater diameter than said second cylindrical surface, said second member further includes a sixth cylindrical surface of greater diameter than said fifth cylindrical surface of said first member, at least a third pair of circular, coplanar, electrically conductive rings, one thereof being disposed on the fifth cylindrical surface of said first member and the other thereof being disposed on the sixth cylindrical surface of said second member, the respective diameters of said third pair of rings providing a third relatively large radial gap therebetween, and at least one resilient filamentary, conductive loop is disposed in said third radial gap.

* * * * *